US007137500B2

(12) United States Patent
Fargo

(10) Patent No.: US 7,137,500 B2
(45) Date of Patent: Nov. 21, 2006

(54) PASSENGER CONVEYOR DRIVE MODULE ARRANGEMENT

(75) Inventor: Richard N. Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/537,206

(22) PCT Filed: Jan. 7, 2003

(86) PCT No.: PCT/US03/00411

§ 371 (c)(1),
(2), (4) Date: Jun. 3, 2005

(87) PCT Pub. No.: WO2004/063078

PCT Pub. Date: Jul. 29, 2004

(65) Prior Publication Data

US 2006/0027438 A1 Feb. 9, 2006

(51) Int. Cl.
*B66B 23/02* (2006.01)

(52) U.S. Cl. ..... 198/330; 198/331

(58) Field of Classification Search ..... 198/330, 198/331

See application file for complete search history.

(56) References Cited

U.S. PATENT DOCUMENTS

| | | | | |
|---|---|---|---|---|
| 3,321,060 | A * | 5/1967 | Mullis et al. | 198/331 |
| 3,365,051 | A | 1/1968 | Mullis et al. | |
| 3,366,217 | A * | 1/1968 | Tosato et al. | 198/833 |
| 3,658,166 | A * | 4/1972 | Hara et al. | 198/331 |
| 4,397,096 | A | 8/1983 | Kraft et al. | |
| 4,895,240 | A * | 1/1990 | Bruehl et al. | 198/331 |
| 6,450,317 | B1 * | 9/2002 | Fargo et al. | 198/330 |
| 6,685,004 | B1 * | 2/2004 | Fargo et al. | 198/330 |

OTHER PUBLICATIONS

PCT International Search Report for International Application No. PCT/US03/00411, mailed Apr. 23, 2003.

* cited by examiner

*Primary Examiner*—James R. Bidwell
(74) *Attorney, Agent, or Firm*—Carlson, Gaskey & Olds

(57) ABSTRACT

A passenger conveyor system (20) has a drive module that engages only one side (50) of the step chain loop (30). In a multiple drive module arrangement, at least one of the drive modules (40B) engages both sides (50, 52) of the step chain loop while another engages only one side (50). The inventive arrangement is not sensitive to spacing (54, 56) between the drive modules. Another example embodiment includes a synchronizing module (60) that engages both sides (50, 52) of the step chain loop (30).

14 Claims, 3 Drawing Sheets

PASSENGER CONVEYOR DRIVE MODULE ARRANGEMENT

BACKGROUND OF THE INVENTION

1. Field of the Invention

This invention generally relates to passenger conveyors. More particularly, this invention relates to drive modules for passenger conveyors.

2. Description of the Prior Art

Passenger conveyors are well known and in widespread use. Escalators or moving walkways typically include a plurality of steps that move along a path to carry passengers from one location to another such as between floors in a building. Typical arrangements include a step chain having a plurality of links associated with the steps. The step chain moves in a loop corresponding to the loop followed by the steps. A drive module engages the step chain to cause the desired movement of the steps.

In modular conveyors, more than one drive module can be used to carry the anticipated passenger load, for example. Instead of using larger motors to compensate for the length of the passenger conveyor or the system construction, multiple drive modules may be employed. Passenger conveyors having multiple drive modules are known.

There are difficulties in utilizing more than one drive module for a passenger conveyor. One problem is associated with the spacing between the drive modules. If the spacing is not accurately controlled, the load carried by each drive module is not equal, increasing wear in the higher-loaded module(s). Further, even when accurate spacing is achieved, changes in the system over time (i.e., wear on system components or material contraction or expansion due to environmental factors) requires periodic maintenance and adjustment. Without accurate spacing between the drive modules in conventional arrangements, the portions of the step chain between the drive modules see varying amounts of compression or tension, depending on the situation.

U.S. Pat. No. 4,397,096 presents one proposed solution to this problem. That patent describes a device for measuring compression or tension on step chain links to determine whether the spacing between drive modules is accurate. While such a device may facilitate placement of the drive modules or adjustment of the modules over time, the difficulty of accurate placement and load distribution among the drive modules still exists. Even with such a device, there are additional expenses associated with the maintenance and inspection of the escalators.

Conventional arrangements include a steel truss for supporting the elevator. The truss typically includes a track or other structure for guiding the step chain links along a chain loop. Such conventional arrangements Limit the materials that are useable for making the step chain links. Specifically, steel must be used for the step chain links to avoid different thermal expansion properties between the chain and the truss. With differing materials having differing thermal expansion properties, the tension on the drive chain may change responsive to a changing environment, which then necessitates further adjustment of the escalator drive system. Making such adjustments is impractical and, therefore, conventional arrangements have only included the same material used to make the escalator truss structure and the step chain links.

There is a need for an improved arrangement that allows using multiple drive modules for a passenger conveyor. This invention provides a system that eliminates the need to control the spacing between the modules, avoids uneven distribution of forces between drive modules and overcomes the shortcomings and drawbacks of the prior art described above.

SUMMARY OF THE INVENTION

In general terms, this invention is a passenger conveyor with a drive module arrangement that permits more convenient and economical use of multiple drive modules.

One system designed according to this invention includes a plurality of steps that are moveable along a step loop having a passenger side and a return side. A step chain is associated with the steps. The step chain is moveable along a chain loop having a first side corresponding to the passengers side of the step loop and a second side corresponding to the return side of the step loop. At least one drive module has a motor and a drive member that engages the step chain only on one of the first side or the second side of the chain loop. The motor moves the drive member to cause selective movement of the chain and the steps.

In one example system a second drive module has a motor and a drive member that engages the step chain on both sides of the chain loop.

In another example, a synchronizing module has a synchronizing member that engages the step chain on both sides of the chain loop.

A method of moving a step chain in a passenger conveyor system designed according to this invention includes providing a drive module that has a drive member that is adapted to engage only one side of the step chain to apply a motive force for moving the step chain along the loop.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figures 1, 1A:
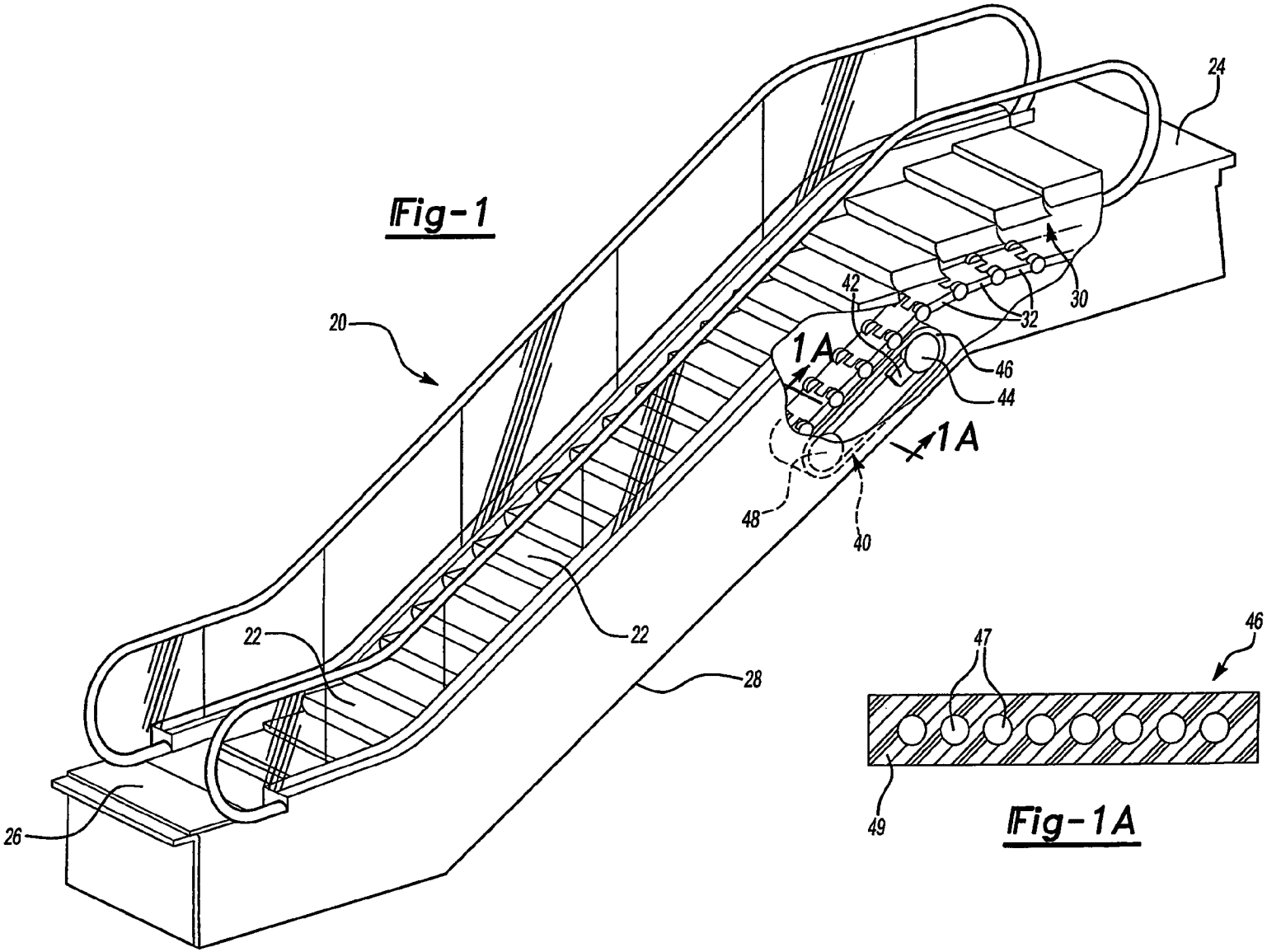
FIG. 1 schematically illustrates a passenger conveyor system designed according to this invention.
FIG. 1A is a cross sectional view taken along the line 1A in FIG. 1.

FIG. 1 schematically illustrates a passenger conveyor system 20, which is an escalator in this example. This invention, however, is not limited to escalators but is applicable to other types of passenger conveyors, such as moving walkways. The illustrated passenger conveyor system 20 includes a plurality of steps 22 that are moveable along a loop so that the steps 22 carry passengers between landings 24 and 26.

A truss structure 28 supports the escalator system components in a known manner. The truss structure 28 in one example is made primarily of steel and accommodates movement of the steps 22 along a path that has a passenger carrying side (illustrated) and a return side (not illustrated). As known, the return side of the step loop typically is hidden within the truss or other structure surrounding the conveyor system components.

A step chain is associated with the steps 22 and moves along a loop 30. The step chain includes a plurality of step chain links 32. The step chain is supported by appropriate portions of the truss structure 28 so that it is moveable along the chain loop 30 in a known manner.

A drive module 40 propels the step chain and the steps 22 as required to move passengers between the landings 24 and 26. The drive module 40 includes a motor 42 that causes a drive sheave 44 to rotate at a desired speed. Movement of the drive sheave 44 causes movement of a drive member 46, which engages the step chain for moving the steps 22 as desired. An idler sheave 48 supports an opposite end of the drive member 46. In one example, the drive member 46 is a drive chain. In a preferred arrangement (schematically shown in FIG. 1A), the drive member 46 is a belt made from a plurality of load-bearing cords 47 imbedded in urethane material 49. The drive member 46 preferably has an exterior surface that is contoured to provide the appropriate non-slip engagement with the step chain. Those skilled in the art who have the benefit of this description will be able to select or design a drive member to meet the needs of their particular situation.

Figure 2:
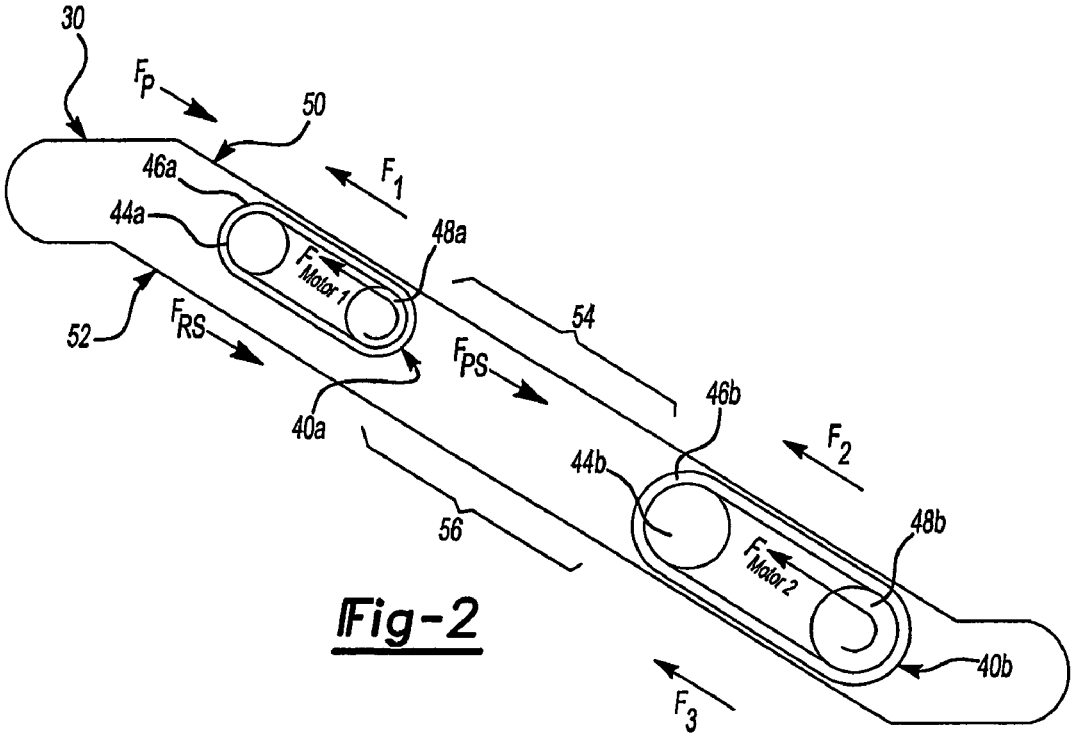
FIG. 2 schematically illustrates a first example embodiment of a passenger conveyor system designed according to this invention.

As best appreciated from FIG. 2, the step chain loop 30 includes a first side 50 that corresponds to the passenger side of the step loop and a second side 52 that corresponds to the return side of the step loop. Only selected portions of the escalator system 20 are schematically shown in FIG. 2. This example arrangement includes a first drive module 40A and a second drive module 40B that each provide a motive force for moving the step chain along the chain loop 30. The drive module 40A engages the step chain only on the first side 50 of the step chain loop 30. The drive module 40B engages both sides 50 and 52 of the step chain loop 30. Having a drive module that engages only one side of the step chain loop 30 is a significant departure from conventional arrangements. Module 40A could engage step chain loop 30 only on second side 52, but that would increase load on the belt at the drive module 40B.

With the inventive arrangement, the spacing between the drive modules need not be tightly or accurately controlled as was required in conventional arrangements. The portions of the step chain shown at 54 and 56 will not experience changes in compression or tension (due to drive module position changes, wear or thermal expansion) because the drive module 40A imparts a force F1 only to first side 50 of the step chain loop 30. This invention provides the advantage of not having to precisely control the spacing between the drive modules and, instead, allows for greater freedom and variability of placement of the drive modules within the confines of the escalator system.

With conventional arrangements having multiple drive modules, the weight supported by each module is indeterminant. The forces associated with each drive module introduce more variables than can be solved (based on the known relationships) and, therefore, accurate force determination at each module is not possible and more complicated adjustment routines are required.

In contrast, the inventive arrangement provides a statically determinant system that is not sensitive to the spacing between the drive modules. The inventive arrangement provides a system that can be described by five equations with five variables. Therefore, the inventive arrangement is a determinant system with an equal number of variables and equations, which is solvable. The tracks (not illustrated) that guide the steps around the turnarounds preferably are designed so as to not carry any significant load so that the following equations may be used. Such a design avoids any force transfer between the passenger and return sides of the step chain except through a drive module that contacts both sides.

For example, the belt 46A of the drive module 40A applies a force $F_1$ and the belt 46B of the drive module 40B applies a force $F_2$, both on the first side 50 (i.e., the passenger side) of the step chain loop 30 in the example of FIG. 2. The following equations describe the system:

$$F_1+F_2=F_P+F_{PS};$$

$$F_3=F_{RS};$$

$$F_{MOTOR1}=F_{MOTOR2}\text{(for matched motors);}$$

$$F_{MOTOR2}=F_2-F_3;\text{ and}$$

$$F_{MOTOR1}=F_1;$$

where $F_3$=the force from the belt 46B applied to the second side 52 (i.e., the return side) of the loop 30; $F_P$=the weight of the passengers; $F_{PS}$=the weight of the passenger side steps and chain; $F_{RS}$=the weight of the return side steps and chain; $F_{MOTOR1}$=the force applied to the belt 46A by the MOTOR1 of the drive module 40A; and $F_{MOTOR2}$=the force applied to the belt 46B by the MOTOR2 of the drive module 40B.

With the inventive arrangement the load imposed on the step chain by the modules that engage only one side of the chain loop 30 is the motor torque divided by the effective pulley radius. That load is determinable using the known relationship between the motor torque and the speed of chain movement.

In one example arrangement, the drive module that engages both sides of the step chain loop 30 includes a smaller motor to equalize the force transferred from the drive module to the passenger side at each module. The drive module (i.e., 40B) that engages both sides of the step chain loop 30 applies motor torque to the passenger side of the step chain and transfers the weight of the return side of the loop 30 to the passenger side (i.e., the first side 50). In this example, the smaller motor of the drive module that engages both sides, therefore, allows for an equal distribution of force applied to the passenger side of the step chain loop at each drive module.

The spacing between the second side 52 of the step chain loop 30 and the drive module 40A may be accomplished as illustrated in several ways. In one example, the drive modules are the same size but the spacing between the passenger side and the return side of the tracks (not illustrated) that guide the step chain loop 30 is increased in the vicinity of the drive module 40A. In another example, the spacing is accomplished by utilizing a smaller sized drive module 40A compared to the drive module 40B. The size of the sheaves 44A and 48A are smaller than the sheaves 44B and 48B. Similarly, the drive member 46A could be smaller, or the sheaves 44A and 48A could be slightly farther apart. This provides additional advantages of allowing the use of smaller components, which introduces space savings and other enhanced system economies such as lower motor torque and more system design flexibility.

Another advantage of this invention is that it makes it possible to use different materials for malting the step chain links 32. For example, aluminum is one desirable material because of its light weight and corrosion resistance properties. With the inventive arrangement, different expansion rates between the link material (i.e., aluminum) and the truss or guide material (i.e., steel) do not cause complications.

Although not specifically illustrated, in another example arrangement, the drive modules 40A and 40B are the same size and the step chain loop path is diverted away from one side of one of the drive modules so that the drive module engages only the first side 50 of the step chain loop 30. Those skilled in the art who have the benefit of this description will realize the most effective way to achieve the spacing required between a drive module and a step chain so that the drive module engages only one side of the step chain to meet the needs of their particular situation.

Figure 3:
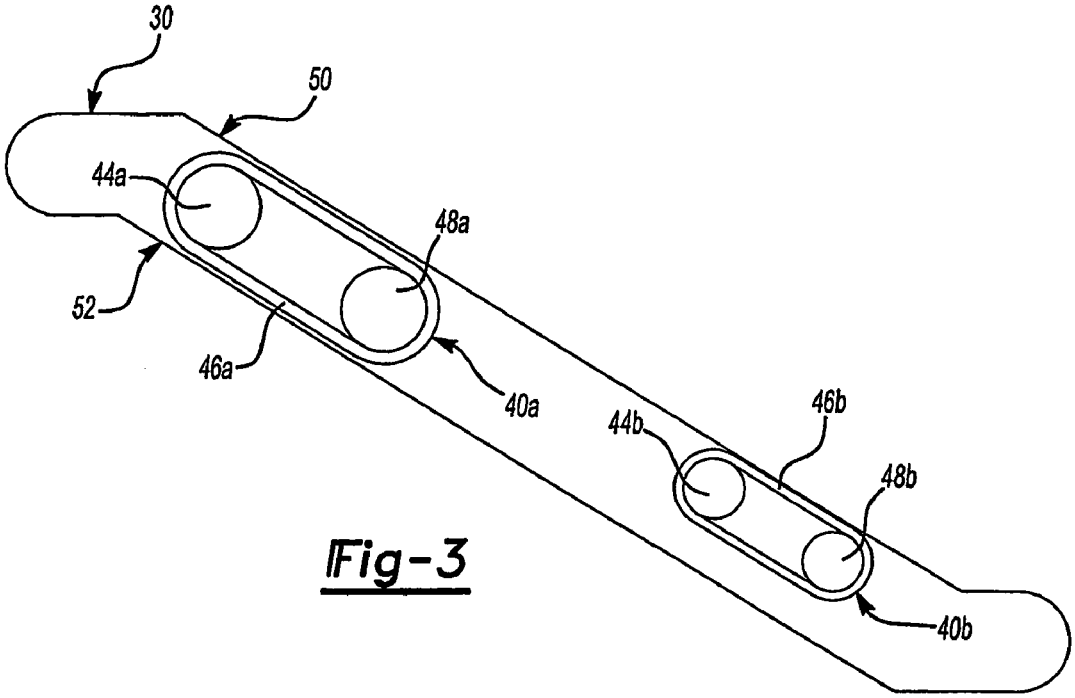
FIG. 3 schematically illustrates a second example embodiment of a passenger conveyor system designed according to this invention.

FIG. 3 illustrates another example arrangement where the drive module 40A engages both sides 50 and 52 of the step chain loop 30 while the drive module 40B engages only the first side 50 of the step chain loop 30. The placement of the drive modules can be varied depending on the needs of a particular situation.

Figure 4:
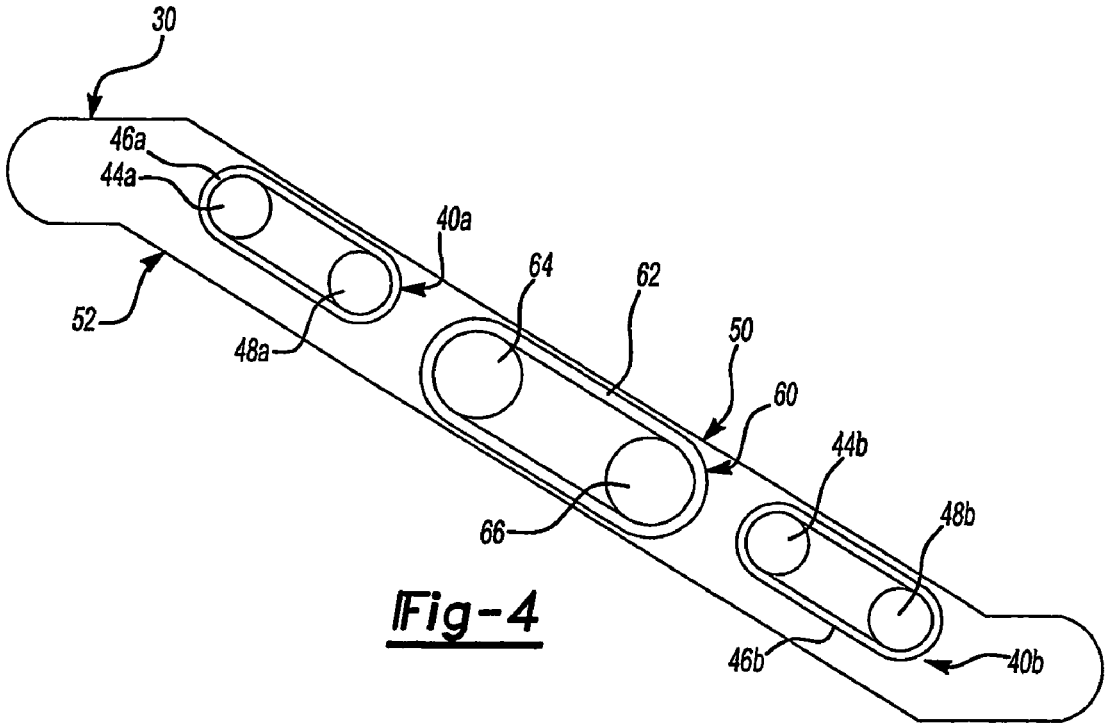
FIG. 4 schematically illustrates a third example embodiment of a passenger conveyor system designed according to this invention.

FIG. 4 illustrates another example embodiment of this invention. In this example, drive modules 40A and 40B both engage only the first side 50 of the step chain loop 30. A synchronizing module 60 includes a synchronizing member 62 that engages both sides 50 and 52 of the step chain loop 30. The synchronizing module includes free-wheeling sheaves 64 and 66 that support the synchronizing member 62 for proper engagement with the step chain 30. The synchronizing module 60 transfers force from the second side to the first, but does not add any power to the step chain system. Such an arrangement allows for utilizing smaller drive modules, because they do not have to engage both sides of the chain loop. In an arrangement such as illustrated in FIG. 4, any number of drive modules may be used.

In one example, the synchronizing module 60 includes a synchronizing member 62 that corresponds to the drive members 46A and 46B (i.e., a urethane-coated belt). The synchronizing member 62 preferably has an exterior surface that is contoured to provide the appropriate engagement with the step chain. Those skilled in the art who have the benefit of this description will be able to select or design a synchronizing member to meet the needs of their particular situation.

Figure 5:
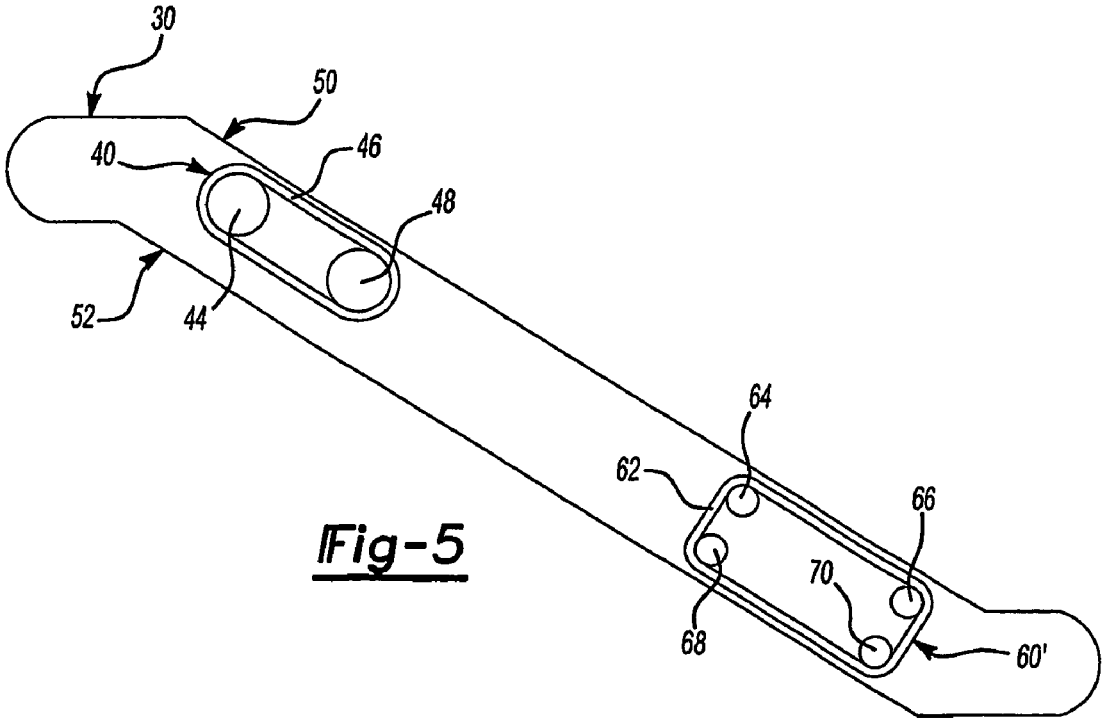
FIG. 5 schematically illustrates a fourth example embodiment of a passenger conveyor system designed according to this invention.

FIG. 5 illustrates another example embodiment of this invention. In this example one drive module 40 moves the step chain loop 30 by engaging only the first side 50 of the step chain. A synchronizing module 60' includes a synchronizing member 62 that engages both sides 50 and 52 of the step chain loop 30. In this example, a plurality of sheaves 64, 66, 68 and 70 support the synchronizing member 62 so that appropriate engagement with the step chain is achieved. The sheaves 64–70 may be supported by the truss structure in a conventional manner so that they allow the synchronizing member 62 to move responsive to movement of the step chain 30 thereby transferring force from the second side to the first without adding any power to the step chain system.

The preceding description is exemplary rather than limiting in nature. Variations and modifications to the disclosed examples may become apparent to those skilled in the art that do not necessarily depart from the scope of this invention. The scope of legal protection given to this invention can only be determined by studying the following claims.

I claim:

1. A passenger conveyor system, comprising:

a plurality of steps that are moveable along a step loop having a passenger side and a return side;

a step chain that is distinct from the steps, associated with the steps and that is moveable along a chain loop having a first side corresponding to the passenger side of the step loop and a second side corresponding to the return side of the step loop;

at least one drive module having a motor and a drive member that engages the step chain only on one of the first side or the second side of the chain loop to cause selective movement of the chain and the steps; and a second drive module having a motor and a drive member that engages the step chain on both sides of the chain loop.

2. The system of claim 1, wherein the at least one drive module engages only the first side of the chain loop and wherein the first side corresponds to a passenger side of the loop.

3. The system of claim 1, wherein the at least one drive module includes a drive sheave that moves the drive member responsive to the motor and the sheave has an outside dimension that leaves spacing between the step chain loop second side and the drive member.

4. The system of claim 1, wherein the drive member comprises a drive belt.

5. The system of claim 4, wherein the belt comprises load-bearing cords imbedded in a urethane material.

6. The system of claim 3, including a synchronizing module having a synchronizing member that engages the step chain on both sides of the chain loop.

7. The system of claim 3, wherein the drive member comprises a non-metallic belt.

8. The system of claim 3 including a truss structure made from a first metal material and wherein the step chain links are made from a second metal material.

9. A passenger conveyor system, comprising:

a plurality of steps that are moveable along a step loop having a passenger side and a return side;

a step chain that is distinct from the steps, associated with the steps and that is moveable along a chain loop having a first side corresponding to the passenger side of the step loop and a second side corresponding to the return side of the step loop;

at least one drive module having a motor and a drive member that engages the step chain only on one of the first side or the second side of the chain loop to cause selective movement of the chain and the steps; and a synchronizing module having a synchronizing member that engages the step chain on both sides of the chain loop.

10. The system of claim 9, including a second drive module having a motor and a drive member that engages the step chain only on the first side of the chain loop.

11. A passenger conveyor system, comprising:

a plurality of steps that are moveable along a step loop having a passenger side and a return side;

a step chain that is distinct from the steps, associated with the steps and that is moveable along a chain loop having a first side corresponding to the passenger side of the step loop and a second side corresponding to the return side of the step loop;

at least one drive module having a motor and a drive member that engages the step chain only on one of the first side or the second side of the chain loop to cause selective movement of the chain and the steps; and a truss structure comprising a first material and wherein the step chain links comprise a second material.

12. A method of moving a passenger conveyor step chain along a loop having two sides, comprising the steps of:

providing a drive module having a drive member adapted to engage the step chain; and engaging the drive member to only one side of the step chain loop;

providing at least one of a second drive module having a second drive member or a synchronizing member, and engaging the at least one of the second drive member or the synchronizing member to both sides of the step chain loop.

13. The method of claim 12, wherein the engaging step comprises engaging the drive member to only the passenger side of the step chain.

14. A passenger conveyor system, comprising:

a plurality of steps that are moveable along a step loop having a passenger side and a return side;

a step chain associated with the steps and that is moveable along a chain loop having a first side corresponding to the passenger side of the step loop and a second side corresponding to the return side of the step loop;

at least one drive module having a motor and a drive member that engages the step chain only on one of the first side or the second side of the chain loop to cause selective movement of the chain and the steps; and at least one of a second drive module having a motor and a drive member that engages the step chain on both sides of the chain loop, or a synchronizing module having a synchronizing member that engages the step chain on both sides of the chain loop.

* * * * *